United States Patent [19]

Foley

[11] 4,022,473

[45] May 10, 1977

[54] APPARATUS FOR PLAYING MATCHING GAME

[76] Inventor: Charles F. Foley, 3908 Merriam Road, Minnetonka, Minn. 55343

[22] Filed: June 10, 1975

[21] Appl. No.: 585,764

Related U.S. Application Data

[63] Continuation-in-part of Ser. No. 395,392, Sept. 10, 1973, abandoned.

[52] U.S. Cl. ..... 273/130 R; 273/136 C; 273/136 K

[51] Int. Cl.[2] ..... A63F 3/00

[58] Field of Search .... 273/130 R, 130 AC, 130 D, 273/130 E, 131 BA, 136 C, 136 E, 136 R, 136 K; 40/68

[56] References Cited

UNITED STATES PATENTS

| | | | |
|---|---|---|---|
| 2,053,598 | 9/1936 | Blau | 273/130 D |
| 2,100,421 | 11/1937 | Wupper | 273/130 D |
| 3,149,842 | 9/1964 | Cirrincione | 273/130 D |
| 3,212,782 | 10/1965 | Jungels | 273/130 D |
| 3,378,261 | 4/1968 | Schriber | 273/130 R |
| 3,514,110 | 5/1970 | Thomander | 273/130 D |
| 3,618,953 | 11/1971 | Lanza | 273/130 D |
| 3,781,014 | 12/1973 | Kolwicz | 273/136 R |

FOREIGN PATENTS OR APPLICATIONS

| | | | |
|---|---|---|---|
| 21,040 | 9/1906 | United Kingdom | 40/68 |
| 336,199 | 10/1930 | United Kingdom | 40/68 |
| 1,128,269 | 9/1968 | United Kingdom | 273/130 E |

OTHER PUBLICATIONS

"And Now, Master Mind," Article Appearing on p. 73 of the Dec. 1, 1975 Issue of Time Magazine.

*Primary Examiner*—Richard C. Pinkham
*Assistant Examiner*—Harry G. Strappello
*Attorney, Agent, or Firm*—Dugger, Johnson & Westman

[57] ABSTRACT

A game apparatus for playing matching games involving colored pegs wherein two players, one on each of the sides of the apparatus will select four pegs of color and place them in a particular sequence unknown to his opponent. A game board provided has apertures for receiving pegs in horizontal rows so that each player can mark on the game board the peg color and sequence arrangement he guesses to be the arrangement selected by his opponent. The game board then is rotated 180° and each player checks his opponent's lineup of pegs and indicates on the board with additional marking pegs whether the opponent matched the player's colors and/or mated the position of the player's pegs. The board is then rotated 180° again and each player again attempts to deduce or guess the opponent's colors and mate the order of colors on a different line of apertures. Play continues until one player matches both the colors and the order of colors of his opponent.

26 Claims, 9 Drawing Figures

37
22
44
26
41
20F
20D
36
20G
20A
40
23
42
24
39
43
45
32
24
38
5
5
5
5
15
27
15
16
10

20C
20B
20D
20E
26
25
32
23
24
38
14
11
12
10
22
43
40
41
20
27
15
21
13
14
42
20A
20G
20D
20F

FIG. 3
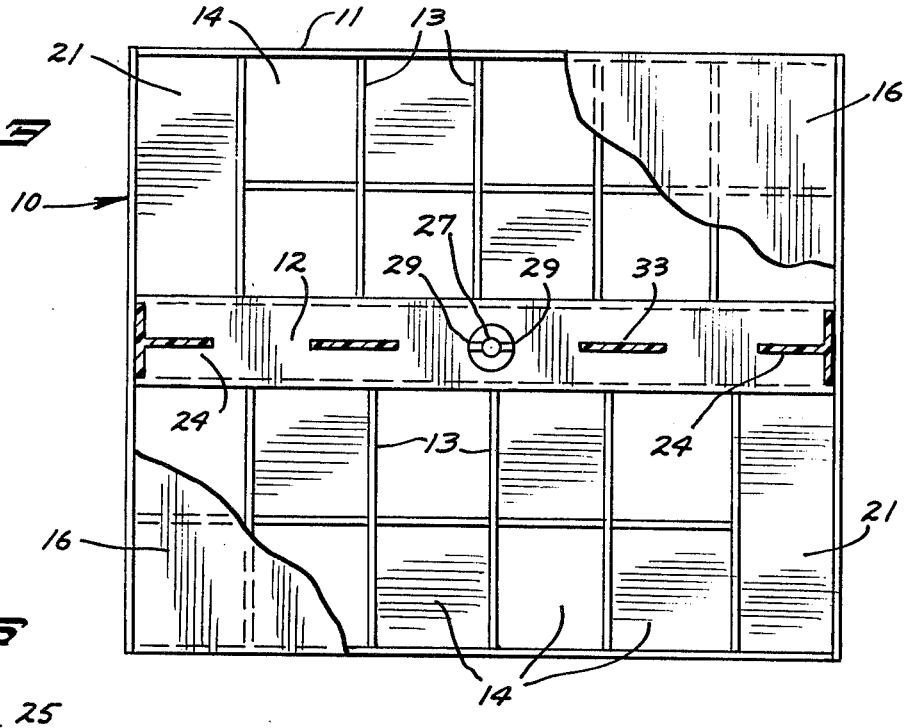
FIG. 5
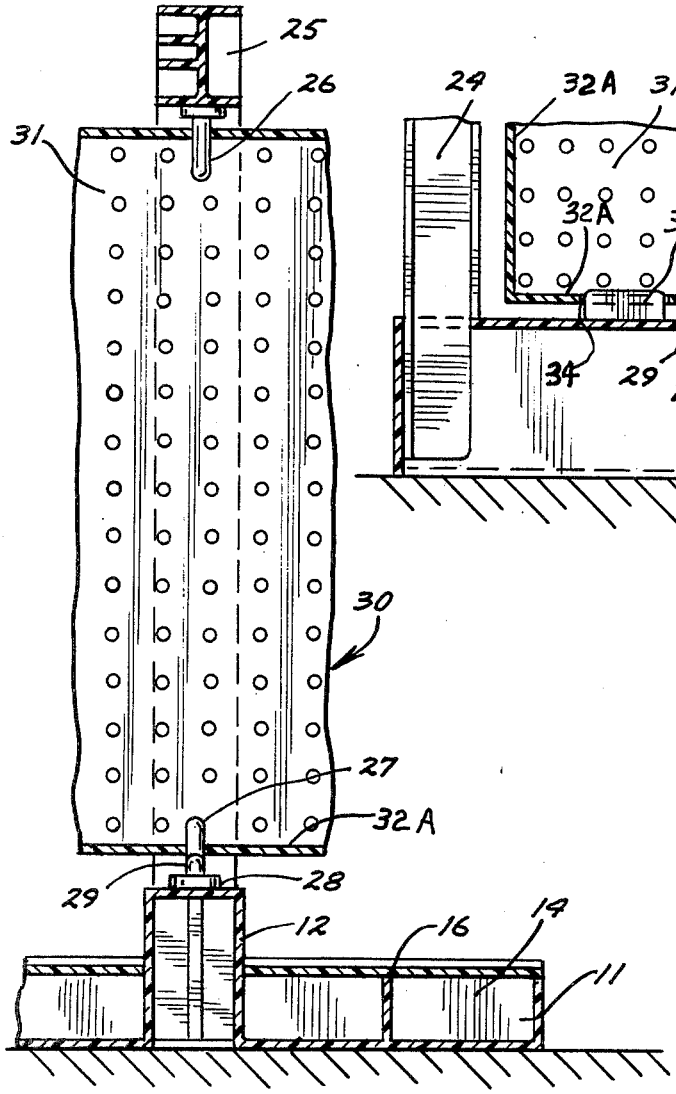
FIG. 4
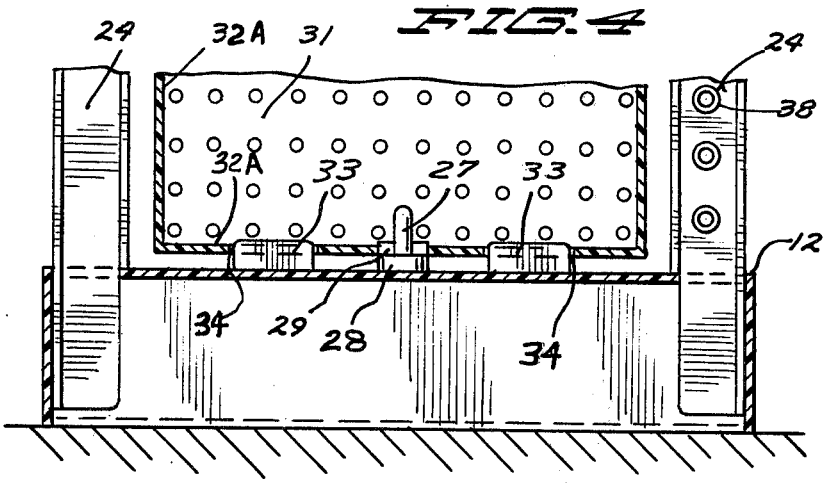
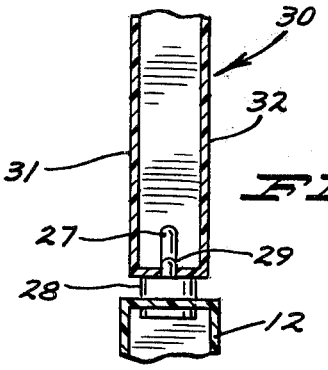
FIG. 6

APPARATUS FOR PLAYING MATCHING GAME

CROSS REFERENCE TO RELATED APPLICATION

This application is a continuation-in-part of my copending U.S. Pat. application Ser. No. 395,392, filed Sept. 10, 1973, now abandoned for Apparatus For Playing Matching Game.

BACKGROUND OF THE INVENTION

1. Field of the Invention

The present invention relates generally to game apparatus for playing matching games.

2. Prior Art

Matching games have long been popular and the way of scoring matching games is varied quite considerably. The usual way for scoring such games is simply to keep score on a piece of paper or the like.

In the present device, a matching game using colored pegs for score keeping is presented with a movable game board that aids in keeping score and increases the playability and fun of the game.

SUMMARY OF THE INVENTION

The present invention relates to a game board apparatus for playing matching games which has a central board mounted about an upright axis that can be pivoted about this upright axis a full 360° and can be locked at each 180° of rotation.

The board is mounted in a frame, and the frame is supported at a base that includes a number of compartments for containing pegs for scoring.

The board is provided with apertures for receiving the pegs in rows. The board is used for playing a matching game wherein players sitting on opposite sides of the board will, unknown to their opponent, select in provided receptacles, a plurality of different colors in a particular order. Then, the players, without seeing the opponent's selection, will first attempt to guess what their oppoent's selection of colored pegs is. The guessing player will place this selection in a horizontal row is provided apertures on his own side of the board.

Means are provided for scoring. If there is a match of colors (in other words if the opponent selected any one of the player's colors) the match will be marked by the player in a provided location. If a colored peg placed by the opponent corresponds not only in color but also in relative position to one selected by the player, this is called a "mate" and an appropriate marking peg is placed in another group of apertures on the board to indicate that a mate has been achieved. The scoring apertures are arranged in rows for convenient scoring.

Then, the board is again rotated 180° so the original sides of the board face the player that made the selections on the board, and the player will again make a second selection in a second different row of apertures after seeing whether he made any matches of the opponent's selections or mates of the opponent's selections. The play is continued then until one of the players mates all of the opponent's selections both as to color or other indicia and also as to order or position.

The board is made so that it will rotate easily, and can be locked into place with suitable locking means. The base of the board contains compartments for colored pegs with a sliding cover over the compartments to keep the pegs retained in place when the board is not being used. The frame for supporting the playing board can be removably mounted so that the unit can be disassembled for storage.

BRIEF DESCRIPTION OF THE DRAWINGS

FIG. 3 is a sectional view taken as in line 3—3 in FIG. 2;

FIG. 4 is a fragmentary vertical sectional view of the center portions of the game board of FIG. 2;

FIG. 5 is a sectional view taken as in line 5—5 in FIG. 2, with the game board rotated 90° to show its position during rotation;

FIG. 6 is a sectional view taken generally along the same line as FIG. 5, showing fragmentarily the lower portions of the locking means in the game board locked thereon;

DESCRIPTION OF THE PREFERRED EMBODIMENTS

Figure 1:
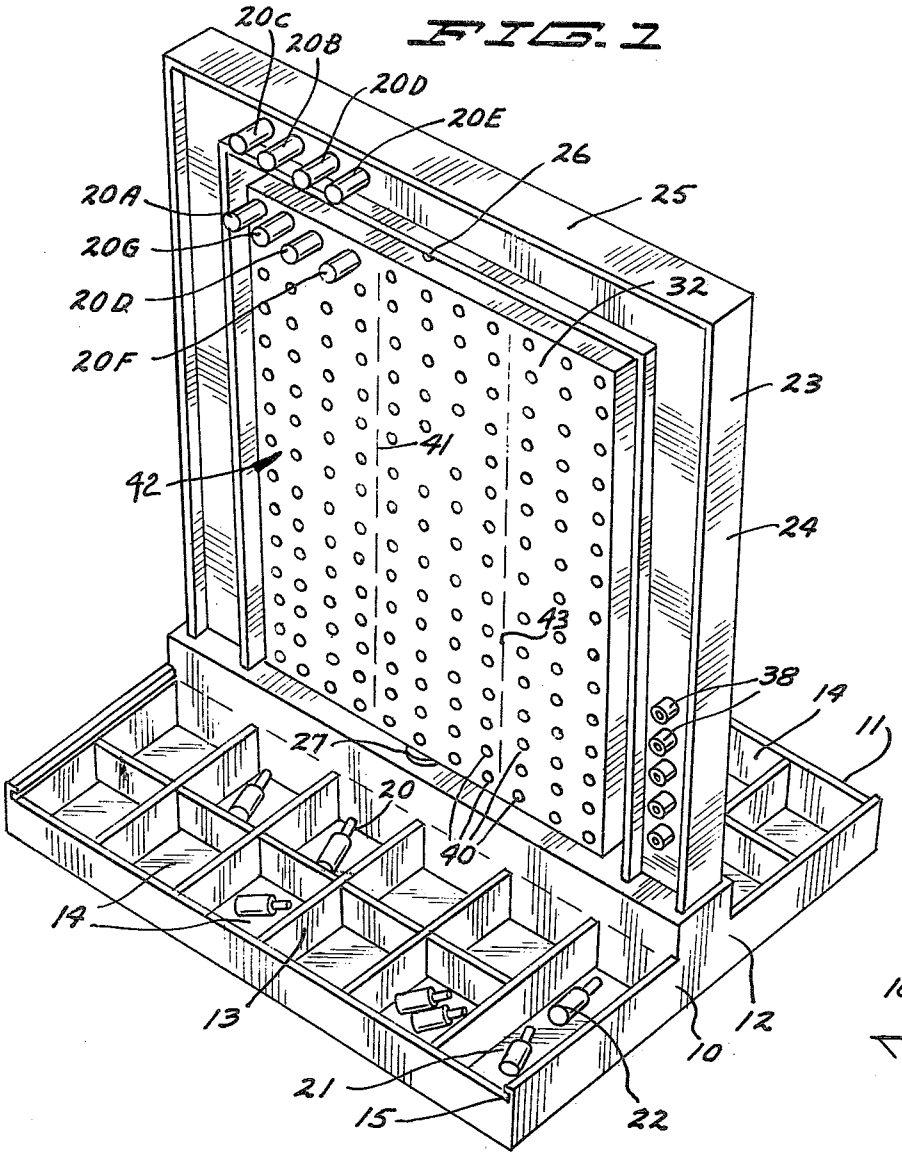
FIG. 1 is a fragmentary prospective view of a game apparatus made according to the present invention.

Referring first to FIG. 1, it can be seen that a base member 10 for the game apparatus comprises upright peripheral walls 11, and a center pedestal or support member 12 formed between the sides of the base and extending transversely. The center member 12 divides the unit in half in transverse direction. The center member 12 is raised up slightly above the upper edges of the rest of the walls, as shown. The interior partitions 13 are positioned on opposite sides of the center member to make a plurality of individual small compartments 14, on opposite sides of the center pedestal.

The side walls 11, of the base are provided with small grooves 15 which are of size to receive a cover member 16 which can be of a clear plastic so that articles in the receptacles 14 can be seen without opening the cover.

The receptacles are designed to hold a plurality of individual pegs 20, as shown schematically, and as will be explained subsequently during explanation of the play, each of the pegs is a particular color. Each of the receptacles 14 hold a plurality of pegs 20 of a particular color. Each of the receptacles 14 is designed to hold a separate one of ten colors used in playing the game. A larger receptacle 21 on each side of the board is used for holding marking pegs 22 which are of a distinctive color used in scoring the play of the game.

A support framework 23 is mounted in the center portions 12 of the board. The framework has upright side legs 24, and a cross piece 25. The legs 23 are of I beam configuration, as shown, and at the lower ends thereof one flange of the framework legs is cut away so the lower ends thereof will slip into receptacles in the top wall of the center portions 12, so they may be held into place. The lower end of the inner flanges of the I beam legs 24 are removed as can be seen in FIGS. 3 and 4 and the lower end of the flange forms a support for the framework 23 on the top wall of the center portions 12, as can be seen in FIG. 4.

The framework cross member 25 has a small shaft 26 mounted thereon, and the center member 12 has an upright support shaft 27 which is coaxial with the peg 26. Shaft 27 is surrounded by a collar 28, as seen perhaps best in FIG. 5, and a pair of flanges 29, which are also seen in FIG. 4 are positioned on diametrically opposite sides of the shaft 27. The peg 26 and the shaft 27 are used for rotatably mounting a game board 30 thereon.

The game board 30 is hollow, having first and second spaced walls 31 and 32, respectively, on opposite sides thereof and walls 31 and 32 are joined by peripheral walls 32A. The top and bottom peripheral walls 32A are provided with openings for receiving the peg 26 and shaft 27, respectively.

Figure 2:
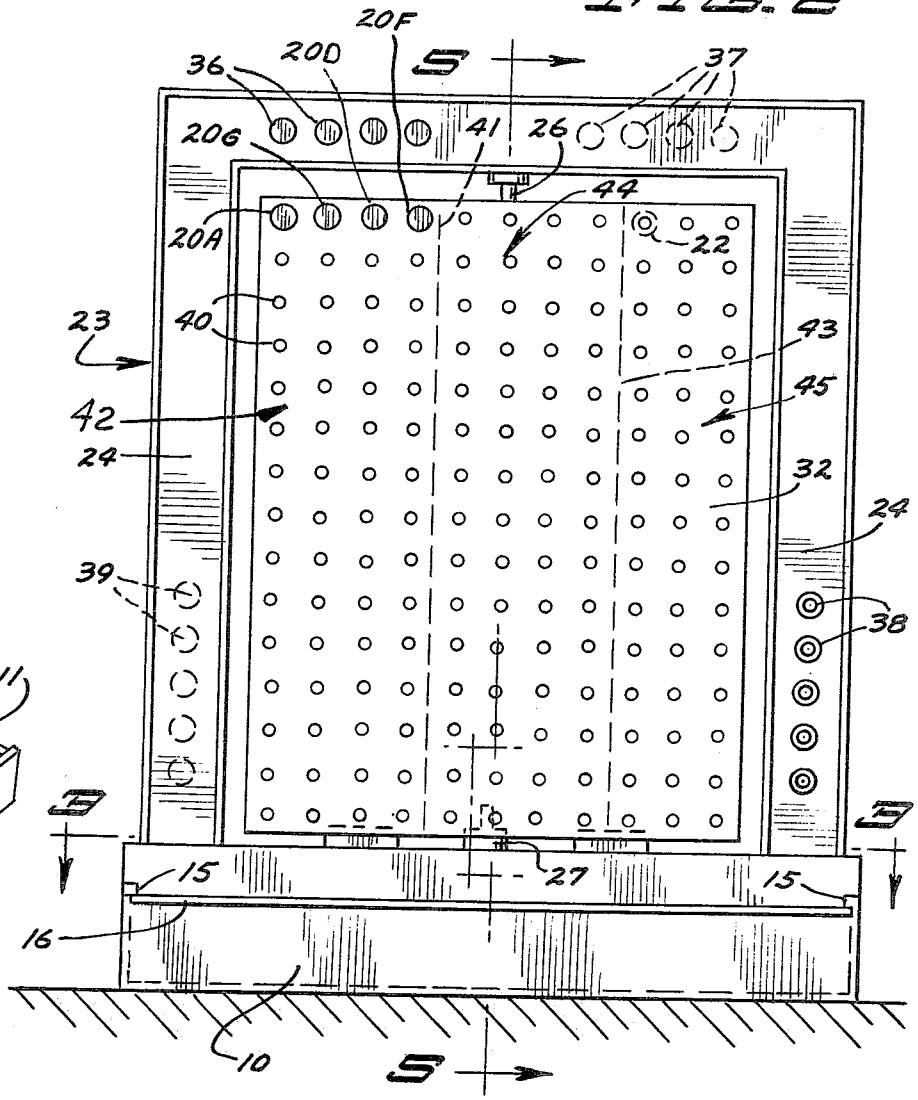
FIG. 2 is a front elevational view of the device of FIG. 1.

The lower peripheral wall 32A is provided with the opening of configuration to receive the flanges 29 when the unit is at its locked position as shown in FIG. 4. The opening in the bottom peripheral wall of the game board member is made of size so that the wall will be supported on the top of the flanges 29 when the game board 30 is rotated out of position generally parallel to the plane of the framework 23. In addition, in order to lock the game board securely in its playing position as shown in FIGS. 1 and 2, a pair of dogs 33 are mounted on the top wall of the center member 12 of the support or base, and the dogs 33 are positioned to align with and enter openings 34 in the bottom peripheral wall of the game board when the board is in its working position. When in position as shown in FIGS. 1, 2 and 4 the game board will drop down onto these dogs 33 and be held positively in place for play.

However, the game board can be lifted quite easily upwardly to clear the dogs 33 and the flanges 29, and then rotated about the axes of pegs 26 and shaft 27 180° and then drop back into place, or the board can be rotated a full 360° if desired.

A plurality of tubular receptacle members 36 are mounted on the near side of the cross member 25, as seen in FIGS. 1 and 2 and tubular members 37 are positioned on the opposite side of the cross member. The tubular members are of size to receive individual pegs 20. As can be seen, the pegs 20 have a large shank, approximately ¼ inch in diameter, and then a small end member approximately ⅛ inch in diameter that would fit into the openings in the tubular members 36 and 37. Also, on the upright legs 24, on the right hand side of the unit as each player faces the playing apparatus, there are tubular members 38 and 39, respectively, for holding pegs as will be more fully explained.

The individual game board panels or walls 31 and 32 are each provided with a plurality of apertures indicated at 40 that are arranged in horizontal rows, and also in vertical rows. As can be seen, there are fifteen apertures 40 in each of the vertical rows, and there are eleven apertures 40 in each of the horizontal rows. The first four vertical rows on the left hand side of each of the wall, when facing the walls generally align with the tubular members 36 or 37 directly above them. The first four vertical rows on the left are the playing portion of the game board. The division of these four rows into the playing group 42 is indicated by a dotted line 41 on wall 32 in FIG. 2.

The second group of four vertical rows of apertures on the walls, as generally indicated at 44 on wall 32 between dotted lines 41 and 43 in FIG. 2, comprise a section for scoring any matching of the colors by an opponent of the pegs in the tubes 36 or 37 with pegs in the first four apertures of each horizontal row of apertures. This will be more fully explained, but it is to be understood the game board is thus divided into a first playing section 42 comprising the first four apertures on the left hand side of each horizontal row of each wall, and the second scoring section 44 comprising the next four apertures of each horizontal row between the dotted lines 41 and 43. This leaves the last three apertures of each horizontal row as a group indicated at 45 which comprises the mate scoring.

In explaining the game, it should be understood that there are pegs of ten different colors. As an aid in explanation of how the game is played, the following code for different colors will be utilized:

A- Red
B- Yellow
C- Dark Blue
D- Green
E- White
F- Gold
G- Pink
H- Light Blue
I- Purple
J- Brown
22- Black In order to play the game, there will be two players, one facing the wall 32, and one facing the wall 31. The person facing the wall 32, and who also will be facing the tubes 36, will be called the player, and the other person will be called the opposer for sake of explanation. The object of the game is for the player and the opposer to each select a particular combination of colored pegs and place these into their respective tubes 36 and 37. Then they each also guess what combination of colors are selected in the tubes of the other party. For example, the player will attempt to guess what the colors and order of pegs are in the opposer's tubes 37 and the opposer will try to guess and show the exact order and color combination of the player's pegs in tubes 36.

In each of the compartments 14 there will be fifteen of the pegs 20, so there will be fifteen of each of the different colored pegs. By way of example, assuming that the player inserts pegs C, B, D and E in his tubes 36 so that there would be a dark blue, a yellow, a green and a white peg respectively, and assuming that the oppposer inserts pegs 20J, 20G, 20H and 20I in his tubes 37 so that he would have a brown, a a pink, a light blue and a purple peg respectively. The object of the game, after this initial selection has been made, is for the opposing party to guess the colors and the order of the colors of the pegs in the other party's tubes at the top of the frame.

To play, for example, the player will then pick out four different colored pegs and place them in the upper horizontal row in the playing section 42 of the wall 32. For example, if he puts in pegs 20A, 20G, 20D and 20F in the apertures of his side of the board, and the opposer than makes a selection of four colors for example, 20J, 20A, 20C and 20E, that he will put in his section 42. The opposite sides of the board will then look as shown in Table I.

PLAYER'S SIDE OF FRAME

TABLE I

| PLAYER'S SIDE OF FRAME | |
|---|---|
| Tubes 36 - | C B D E |

TABLE I-continued

| PLAYER'S SIDE OF FRAME | |
|---|---|
| Top Row of Wall 32 - | A G D F × × × × × × × |

| OPPOSER'S SIDE OF FRAME | |
|---|---|
| Tubes 37 - | J G H I |
| Top Row of Wall 31 - | J A C E × × × × × × × |

The game board is lifted up off its dogs or stop members, and rotated 180° so that the pegs placed by the player will then appear on the left hand side of the opposer. Assuming that the board has been rotated, the sides of the board will be reversed. Wall 32 will face the opposer and wall 31 will face the player. The board will appear as follows in Table II.

TABLE II

| PLAYER'S SIDE OF FRAME | |
|---|---|
| Tubes 36 - | C B D E |
| Top Row of Wall 31 - | J A C E × × × × × × × |

| OPPOSER'S SIDE OF FRAME | |
|---|---|
| Tubes 37 - | J G H I |
| Top Row of Wall 32 - | A G D F × × × × × × × |

It can be seen that the player will have his peg 20G, which is the second from the outside peg, aligned with the opposer's peg 20G in the tubes 37. This is a mate, being not only a correct color, but in the correct position under the color of the opposer into the second from the outside tube 37 so the opposer will then place one of his black pegs in the player's section 45 of the wall 32 in the mate section.

Likewise, the opposer's selection of colors on his section 42 of the playing board, will be aligned with the tubes 36, and if there is a color match (any colors selected by the player and also selected by the opposer and colors match as shown in Table II), the player will place a black peg in the sections of the apertures 44 on the first row of apertures to indicate that there is a match of colors by the opposer. The player has a dark blue peg on the outside tube 36, and the opposer placed a dark blue peg on the third from the left aperture. Also, the opposer had a mate with the player's tubes 36 as can be seen in Table II. The white peg placed by the opposer mates with the white peg (E) of the player's. Then the player would also insert a black peg in the match section 45 (the right hand three vertical rows of apertures) to indicate that the opposer had a mate. Then, before any further play occurred, the board would be again disengaged from its locked means, rotated 180° so that the original wall 32 would again be facing the player and the player would see that he had one match. The opposer would see he has a match and a mate. After scoring and rotation, the board will appear as shown in Table III

TABLE III

| PLAYER'S SIDE OF FRAME (After Scoring and Rotating) | |
|---|---|
| Tubes 36 | C B D E |
| Top Row of Wall 32 - | A G D F × × × × 22 × × |

| OPPOSER'S SIDE OF FRAME (After Scoring and Rotating) | |
|---|---|
| Tubes 37 | J G H I |
| Top Row of Wall 31 - | J A C E 22 × × × 22 × × |

Then each of the player and the opposer would again select four colors of pegs and arrange them in the second from the top horizontal row of apertures and in the playing section 42 of that respective board to try to make all of the pegs of the other party. For example, the board may look as shown in Table IV.

TABLE IV

| PLAYER'S SIDE OF FRAME | |
|---|---|
| Tubes 36 - | C B D E |
| Top Row of Wall 32 - | A G D F × × × × 22 × × |
| Second Row of Wall 32 - | G A D H × × × × × × × |

| OPPOSER'S SIDE OF FRAME | |
|---|---|
| Tubes 37 - | J G H I |
| Top Row of Wall 31 - | J A C E 22 × × × 22 × × |
| Second Row of Wall 31 - | C J G E × × × × × × × |

After rotating the board 180° so wall 32 faces the opposer and wall 31 faces the player the game would appear as shown in Table V for scoring.

TABLE V

| PLAYER'S SIDE OF FRAME (With Wall 31) | |
|---|---|
| Tubes 36 - | C B D E |
| Top Row of Wall 31 - | J A C E 22 × × × 22 × × |
| Second Row of Wall 31 - | C J G E × × × × × × × |

| OPPOSER'S SIDE OF FRAME (With Wall 32) | |
|---|---|
| Tubes 37 - | J G H I |
| Top Row of Wall 32 - | A G D F × × × × 22 × × |
| Second Row of Wall 32 - | G A D H × × × × × × × |

The player then notes that the opposer has two mates (C and E) but no additional matches. The player then places a black peg in the second vertical row of apertures in section 45 and also aligned in the second horizontal row of the wall 31, which is the opposer's playing wall.

The opposer sees that the player has lost his mate, but has two matches of colors so a black peg would be placed in the second horizontal row of apertures and in the second vertical row of group 44 of the match scoring apertures on wall 32 by the opposer.

The board would then again be rotated 180° to its original position and the scoring would appear as shown in Table VI.

TABLE VI

| PLAYER'S SIDE OF FRAME | |
|---|---|
| Tubes 36 | C B D E |
| Top Row of Wall 32 - | A C D F × × × × 22 × × |
| Second Row of Wall 32 - | G A D H × 22 × × × × × |

| OPPOSER'S SIDE OF FRAME | |
|---|---|
| Tubes 37 - | J G H I |
| Top Row of Wall 31 - | J A C E 22 × × × 22 × × |
| Second Row of Wall 31 - | C J G E × × × × × 22 × |

The third from the top row would be used for playing to try to match the pegs of the opposite party in their respective tubes 36 or 37. Play would continue until one party had mated all of the colors, and he would be the winner. It should be noted that all pegs are allowed to remain in the apertures until the game is completed. This insures that the players can use deductive reasoning applied to earlier scores and combinations to arrive at the problem resolution. Thus, reasoning power is exercised in playing.

The tubes 38 and 39 on the vertical legs of the framework are used for playing pegs of discarded colors so that when it is known by the player that a particular color is neither a match nor a mate of the opposer's, he would put a peg of that color into one of the tube 38, for example, to show that this color should not again be used in playing the game.

The game board thus provides a means for keeping score or track of a matching game wherein an initial four indicia is used to have to be matched and mated in a particular order.

The number of colors should be at least double the number of the indicia selected by each player to get good playability. Thus, with four tubes 36 or 37, at least eight colors should be used.

In place of colors, pegs may be formed into different geometric cross section shapes or they may be made with shapes representing animals, or they may bear letters or other desired indicia.

Figure 7:
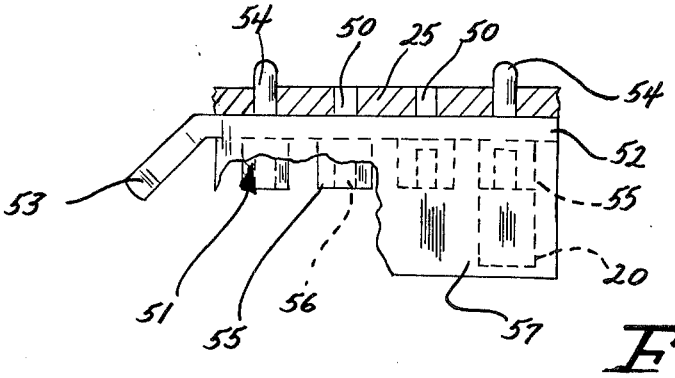
FIG. 7 is a side view of a movable indicator used by the players for ease of indication of portion of markers.
Figure 8:
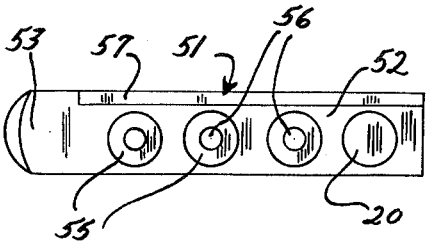
FIG. 8 is a front view of the movable indicator of FIG. 7.
Figure 9:
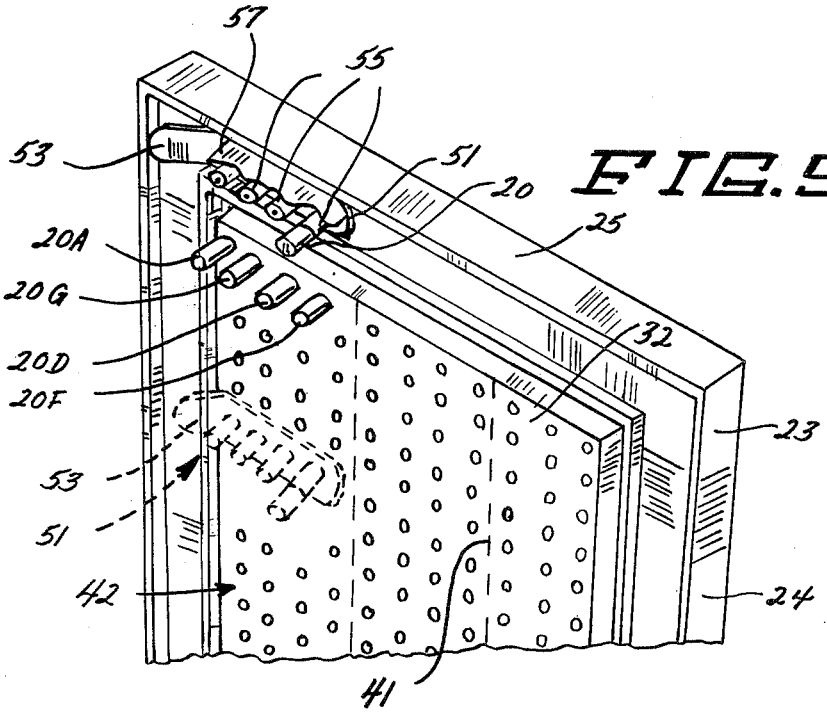
FIG. 9 is a fragmentary perspective view of the game apparatus illustrating the use of the device of FIG. 7, but with a hood broken away for sake of clarity.

Referring to FIGS. 7, 8 and 9, a modification of the playing apparatus is illustrated. The device of FIGS. 7, 8 and 9 is used by a player to permit moving the support members or apertures used for initial section of the players pegs (Item 36 in FIG. 2) so that as the game progresses, the comparison of the initial selection of pegs or indicia members of a player can be easily compared to the selection made by the opposing player. It has been found that when, for example, the play has progressed to a point where pegs placed in the horizontal rows several rows down from the top of the frame have been used, the distance between the initially selected (problem) pegs supported at the top of the board or playing apparatus and the pegs that were placed by the opposing player for scoring is great enough so that it is difficult to score the selections. The present device permits the moving by a player of his problem pegs to a position adjacent to the pegs last played by the opposing player for ease of comparison. It is to be understood that the game would be played exactly as described previously, but that the cross member 25 would be provided with apertures such as those indicated at 36 and such apertures are indicated at 50 in FIG. 7. The cross member 25 has the apertures of size to receive the pegs, and these apertures can be used, but for sake of illustration a new number is provided for the apertures 50 which would correspond to the receptacle members 36. These apertures would be vertically aligned with the playing group 42 (FIG. 9), as previously explained as well.

A movable holder member indicated generally at 51 comprises a base panel 52, and a finger tab or holding tab 53 that is integral with and as shown is inclined at an angle to the base panel 52 to provide clearance along the edges of the game board. It is to be understood of course that this member 51 does not rotate with the game board but would be replaced at the top cross member 25 or held by the respective player out of the sight of the opponent. The base panel 52 has a pair of spaced pegs 54,54 at opposite ends thereof which are spaced apart a distance to fit within at least two of the receptacles 50 and to be removably retained in the cross member 25 or as will be explained to also fit into receptacles or apertures of the game board in location 42. On the opposite side of the panel 52, a hood or shield 57 extends out from the panel 52 along the upper edge, and there are a plurality of tubular receptacle members 55 below the hook 57, each of which has an interior opening 56 of size to receive the end portion of one of the pegs 20, and hold the pegs securely in the same manner as the receptacles 36 hold the pegs. The hook extends far enough to overlie the pegs 20 when they are installed in receptacle members 55.

In FIG. 7 a single peg 20 is shown for illustrative purposes but all receptacle members 55 would hold problem pegs for play. The member 51 is placed in the cross member 25 as shown in FIG. 9, and the initial problem pegs one of which is shown in FIG. 9, (four would be used) would be placed at the top cross member in the receptacle members 55. In FIG. 9 the hood 57 is broken away for clarity. Then, in the course of play, the finger tab 53 can be grasped, and the entire member 51 removed from member 25, carrying the pegs 20 that are held in the receptacle members 55 with it. The device can be placed into position directly below the "guessing or playing pegs" of the opposing player and aligned with such played pegs to compare the colors of the pegs in the holder 51 with the pegs that have been played by the opposing player after the board has been rotated. Such a position for holder 51 is shown in dotted lines in FIG. 9, but the pegs immediately above this position are omitted for clarity.

Thus, the holder member for the players initial selection of pegs is removable, and can be placed adjacent to scoring or guessing pegs of the opposing player even after the game has progressed a substantial number of turns so that the scoring pegs of the opposing player can be readily scored. The hood 57 shields the one players problem pegs from view of the other player during these manipulations.

In this manner the game progresses much more rapidly because it is easier to compare the one player's initially selected pegs with the other player's guessing (playing) pegs, merely by moving the member 51 to position adjacent to the last guessed pegs to be scored. The member 51 can be used for checking previous plays as well. It can be moved up and down the board, and hood 57 can be placed vertically against the ends of the pegs in the board for ease of checking and comparison. The problem pegs are thus easily compared with the played pegs without confusion. The hood provides an adequate shield to screen the problem pegs from the other player.

What is claimed is:

1. A game board apparatus for playing indicia matching games between opposing players comprising a frame, a board member rotatably mounted to said frame for movement between two positions, said board member having at least two surfaces each of which is alternately visible to first and second players in said two positions and not visible to the second player when visible to the first player, a plurality of indicia members of a plurality of different indicia, first means on each side of the frame for retaining a plurality of different indicia members selected by one player and placed in a particular order, said first means of one player being hidden from normal view of the other player, second means on each of said surfaces of said board member for holding a plurality of indicia members in position to indicate on one surface of said board a selection of indicia members, selected to correspond to indicia members retained in the first means of the other player, third means on each surface of said board to retain indicia members for a first player to indicate a matching of indicia members in the second members of the second player with indicia members in the first means of the first player, and fourth means on each surface of the board for the first player to indicate a mating as to indicia and position of indicia members in said second means of the second player with indicia members in the first means of the first player.

2. The apparatus of claim 1 wherein said surface of said board member comprises substantially parallel wall surfaces facing in opposite directions.

3. The apparatus of claim 2 and means to releasably stop said board member in said two positions, said positions being substantially 180° from each other.

4. The apparatus of claim 2 wherein said playing surfaces are spaced apart, said means to retain said indicia members comprising a plurality of apertures defined in each of said surfaces, each of size to receive and retain a portion of one indicia member.

5. The apparatus of claim 4 wherein said indicia members comprise pegs of selected color, and means on said pegs to fit into and be retained by said apertures.

6. The apparatus of claim 2 wherein said frame comprises a base, a pair of spaced upright support members and a cross member joining said upright support members, said first means being positioned on said cross member, and means on said cross member and said base forming said rotatable mounting for said board member about a substantially upright axis between said upright support members.

7. The apparatus of claim 2 wherein said frame includes a base, said board member being rotatably mounted in the center portion of said base in position to substantially divide said base into two sections, and wall means dividing each of said sections into compartments, said compartments corresponding in number to the different indicia members and being of size to store said indicia members.

8. The apparatus of claim 7 and cover means on said base to retain said indicia members in said compartments.

9. An apparatus for playing and scoring matching games using different indicia members comprising a frame, a plurality of indicia members of each of a plurality of different indicia for each player, a game board having spaced oppositely facing co-extensive surfaces and being mounted to said frame for rotation about an axis, said board being rotatable about said axis from a first position substantially 180° to a second position whereby the surfaces face in opposite directions in the respective two positions, a plurality of separate means on opposite sides of said frame, each of said separate means being adapted to retain an indicia member in alignment with portions of said game board, first means for retaining indicia members on each of said surfaces arranged in first rows, each first row including a plurality of said first means, each first row being in alignment with one of said separate means with said game board in either of said first or second positions, and parallel second rows of indicia member retaining means on each board surface adjacent to and aligned with the first means forming the first rows and separated therefrom to provide means for scoring said matching games.

10. The apparatus according to claim 9 wherein there are at least four indicia retaining means and four first rows, and said indicia members comprises at least eight different indicia.

11. The apparatus of claim 9 wherein the second rows of indicia retaining means comprise two groups of second rows, the rows in the first group of second rows being equal in number to the number of first rows, and the rows in the second group of second rows being one less than the number of first rows.

12. The apparatus of claim 9 and releasable latch means to retain said game board in at least two positions substantially 180° of rotation apart.

13. The apparatus of claim 9 wherein said game board comprises a hollow structure having spaced apart first and second walls, the first surface being on the outside of said first wall and said second surface being on the outside of said second wall, and wherein said indicia members comprise pegs of selected colors, said pegs each having a main body portion and a reduced diameter retaining portion, and wherein said indicia member retaining means comprises apertures of size to frictionally receive the reduced diameter retaining portion of said pegs.

14. The apparatus of claim 13 wherein said first and second rows each have a plurality of apertures aligning with apertures of adjacent first and second rows to form separate rows of apertures extending at 90° to said first and second rows.

15. The combination as specified in claim 9 wherein said separate means comprises a support selectively separable from said frame, said support being manually movable to positions aligning with and adjacent indicia members retained in said first means.

16. The combination as specified in claim 9 wherein said separate means and said first means each comprise a plurality of receptacles, and a removable support including a plurality of receptacles equal in number to the receptacles defining said first means on a surface thereof and being of size to receive said indicia members, and means cooperating with the receptacles normally comprising said separate means and first means to removably position said support selectively to comprise said separate means and to be moved adjacent to said first means.

17. A game board apparatus for playing indicia matching games between opposing players comprising a support, a plurality of indicia members of a plurality of different indicia, first means on said support for retaining a plurality of different indicia members selected by one player and placed in a particular order, said first means being hidden from normal view of another player, second means on said support for retaining a plurality of indicia members in position to indicate on said support a selection by another player of indicia members selected to correspond to indicia members retained in the first means of the one player, said first and second means being correlated to permit alignment of indicia members in the second means with indicia members in the first means, said second means comprising a plurality of holding means for indicia members arranged in a plurality of substantially parallel rows aligning with the individual indicia members supported by said first means and also arranged in a plurality of rows perpendicular to said aligning rows, third means aligned with each of said perpendicular rows of said second means to retain means to indicate a matching of indicia members in each perpendicular row of second means by the other player with indicia members in the first means of the one player, and fourth means aligning with each of said perpendicular rows of said second and third means to retain means to indicate a mating as to indicia and position of indicia members in said second means by the other player with indicia members in the first means of the one player.

18. The combination as specified in claim 17 wherein all of said means to retain said indicia members comprise a plurality of receptacles defined in said support, each of said receptacles being of size to receive and retain a portion of one indicia member.

19. The combination as specified in claim 18 wherein said support comprises a frame having oppositely facing sides, and portions of said frame shielding the first means of one player from the other player.

20. The combination as specified in claim 19 wherein said support includes a board member rotatably mounted to said frame, said board member having at least two surfaces, each of which is alternately visable to first and second players in said two positions, and said second, third and fourth means are provided on each of said opposite surfaces of said game board.

21. The combination as specified in claim 17 wherein said second means comprise indicia retainers equal in number to said first means in each of the perpendicular rows, and said fourth means comprise indicia retainers one less in number than the indicia retainers comprising said second means in said perpendicular rows.

22. The combination as specified in claim 17 wherein said first means comprises a support separable from said frame, said support being movable to position aligning with indicia in said second means.

23. The combination as specified in claim 18 and a movable support including a plurality of receptacles equal in number to the receptacles comprising said first means on a surface thereof, and being of size to receive said indicia members, and means on an opposite surface of said support to selectively engage the receptacles comprising said first and second means and to removably position said support relative to said first and second means.

24. Means for playing a matching game including a board member, a plurality of indicia members of each of a plurality of different indicia, first locating means mounted relative to said board, second locating means defined on said board for positioning indicia members, said second locating means being arranged in a selected number of first substantially parallel rows and in a selected number of second substantially parallel rows extending in a second generally perpendicular direction, said first locating means being adjacent to but separate from the second locating means, a manually movable support member supportable on said first locating means, said movable support member having a plurality of third locating means for locating indicia members, and said third locating means on said support member being equal in number and substantially equal in spacing to the first rows of second locating means on the game board, and retainer means on said support member on an opposite side thereof from the third locating means to permit locating and removably retaining the movable support member on the first locating means, said retainer means thereby positioning said support member with each separate third locating means spaced from but substantially aligning with one of the first rows of said second locating means.

25. A game board apparatus for playing indicia matching games between opposing players comprising a support, a plurality of indicia members of a plurality of different indicia, first means on said support for retaining a plurality of different indicia members selected by one player and placed in a particular order, said first means being hidden from normal view of another player, second means on said support for retaining a plurality of indicia members in position to indicate on said support a selection by another player of indicia members selected to correspond to indicia members retained in the first means of the one player, said first and second means being correlated to permit alignment of indicia members in the second means with indicia members in the first means, said second means comprising a plurality of holding means for indicia members arranged in a plurality of substantially parallel rows aligning with the individual indicia members supported by said first means and also arranged in a plurality of rows perpendicular to said aligning rows, and means aligned with each of said perpendicular rows of said second means to retain a plurality of means to indicate a matching of indicia members in each perpendicular row of second means by the other player with indicia members in the first means of the one player, and to retain means to indicate a mating as to indicia and position of indicia members in said second means by the other player with indicia members in the first means of the one player.

26. Means for playing a matching game including a board member, a plurality of indicia members of each of a plurality of different indicia, locating means defined on said board for positioning indicia members, said locating means being arranged in a selected number of first substantially parallel rows and a selected number of second substantially parallel rows extending in a second generally perpendicular direction to said first rows, a manually movable support member supportable on said board, said movable support member having a plurality of locating means for locating indicia members thereon, said locating means on said support member being equal in number and substantially equal in spacing to the first rows of locating means on the game board, and a hood member attached to said movable support member and positioned to overlie and shield locating means on the movable support member from the vision of a player.

* * * * *

UNITED STATES PATENT AND TRADEMARK OFFICE

CERTIFICATE OF CORRECTION

PATENT NO. : 4,022,473

DATED : May 10, 1977

INVENTOR(S) : Charles F. Foley

It is certified that error appears in the above-identified patent and that said Letters Patent are hereby corrected as shown below:

Column 1, line 42 "is" should be--in--. Column 4, line 64 "PLAYER'S SIDE OF FRAME" before the words TABLE I should be removed. Column 6, line 26 "make" should be--mate--. Column 8, line 46 "hook" should be--hood--. Column 9, line 41, (Claim 1, line 21), "members" (second occurrence) should be--means--.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*